US007377058B2

(12) United States Patent
Elkington et al.

(10) Patent No.: US 7,377,058 B2
(45) Date of Patent: May 27, 2008

(54) SPORTS BOOT

(75) Inventors: Mark Elkington, Tuen Mun (HK); Ralph Kohler, Oberperfuss (AT)

(73) Assignee: Goodwell International Ltd., Tortola (VG)

( * ) Notice: Subject to any disclaimer, the term of this patent is extended or adjusted under 35 U.S.C. 154(b) by 265 days.

(21) Appl. No.: 10/907,174

(22) Filed: Mar. 23, 2005

(65) Prior Publication Data

US 2005/0241189 A1 Nov. 3, 2005

(30) Foreign Application Priority Data

Mar. 24, 2004 (DE) ..... 10 2004 014 807

(51) Int. Cl.
*A43B 5/04* (2006.01)
*A43B 19/00* (2006.01)

(52) U.S. Cl. ..... 36/117.6; 36/10

(58) Field of Classification Search ..... 36/117.6, 36/10, 55, 115

See application file for complete search history.

(56) References Cited

U.S. PATENT DOCUMENTS

| | | | | |
|---|---|---|---|---|
| 3,718,994 | A * | 3/1973 | Spier | 36/117.1 |
| 3,750,310 | A | 8/1973 | Messner et al. | |
| 4,083,127 | A | 4/1978 | Hanson | |
| 4,255,202 | A | 3/1981 | Swan, Jr. | |
| 5,050,319 | A | 9/1991 | Perotto et al. | |
| 5,509,217 | A | 4/1996 | Condini | |
| 5,878,513 | A * | 3/1999 | Annovi et al. | 36/115 |
| 6,226,898 | B1 | 5/2001 | Trimble et al. | |
| 6,457,265 | B1 * | 10/2002 | Lepage et al. | 36/117.1 |
| 6,993,859 | B2 * | 2/2006 | Martin et al. | 36/50.5 |
| 2001/0001903 | A1 * | 5/2001 | Di Girolamo | 36/3 R |

FOREIGN PATENT DOCUMENTS

| | | |
|---|---|---|
| CH | 626 793 | 12/1981 |
| DE | 86 11 889.7 U1 | 10/1986 |
| EP | 0 232 163 A2 | 3/1987 |
| EP | 0 272 643 A2 | 6/1988 |
| EP | 0 351 396 A2 | 1/1990 |
| EP | 0 370 948 B1 | 5/1990 |
| EP | 0 425 392 A1 | 5/1991 |
| EP | 0 657 116 B1 | 6/1995 |
| EP | 0 672 363 A1 | 9/1995 |
| EP | 0 841 017 A2 | 10/1996 |

* cited by examiner

*Primary Examiner*—Ted Kavanaugh
(74) *Attorney, Agent, or Firm*—Senniger Powers LLP

(57) ABSTRACT

A sports boot comprising an outer shell and an inner boot, with at least one opening in the outer shell and at least one projection on the inner boot assigned to each opening, where the opening(s) and the projection(s) serve to produce a positive fit connection between the inner boot and the outer shell. The outside of the inner boot is optionally made waterproof such that no water enters the inside of the inner boot, despite the presence of the openings in the outer shell.

16 Claims, 3 Drawing Sheets

SPORTS BOOT

FIELD OF THE INVENTION

The invention pertains to sports boots such as ski boots, snowboarding boots, climbing boots, boots for ice skates or in line skates, and the like.

BACKGROUND OF THE INVENTION

Modern sports boots, such as ski boots, snowboarding boots, climbing boots, boots for ice skates or in line skates, etc., usually comprise an outer shell of a relatively firm and rigid plastic material and an inner boot that can be inserted into this outer shell and consists of a comparatively softer cushioning material, where the inner boot fixes the foot relative to the outer shell, and where the cushioning material also contributes significantly to the wearing comfort by protecting the foot from cold temperatures and from developing pressure points.

Boots of this type are known, for example, from EP 0 672 363 A1. In this case, the inner boot is provided with an additional cushioning in the form of fluid filled bubbles at locations vulnerable to the development of pressure points.

EP 0 370 948 B1 describes an inner boot of relatively rigid synthetic material, lined on the inside with a synthetic material of lesser hardness. The relatively rigid synthetic material has at least one cutout of closed outline into which the synthetic material of lesser hardness can be inserted to effect superior cushioning. This softer plastic is attached by means of sewing, welding or molding.

EP 0 351 396 A2 describes an inner boot for a ski boot that consists of a support material and a foam layer with local recesses that extend over at least 30% of the inner boot surface. This is intended to prevent pressure points at particularly critical locations, e.g., the ankle region or the instep region.

EP 0 657 11 6 A1 describes an inner boot with correcting pieces arranged thereon, where said correcting pieces serve for varying the thickness of the inner boot. This is achieved with the aid of an elastic outer lining that is partially cut out and/or open and essentially consists of an inelastic material.

CH 626 793 A5 describes an inner boot for sports boots that can be cushioned by applying additional cushioning elements with the aid of Velcro fasteners.

An objective of the above described sports boot merely consists of preventing pressure points. However, another problem is fixing the inner boot relative to the outer shell. For example, the foot will be quite constricted if the outer shell is closed with relatively high closing forces by means of toothed elements, laces or other conventional elements used to fix the inner boot, and thus the foot, relative to the outer shell. This is not only uncomfortable, but also restricts the blood supply to the foot. This leads to premature muscle fatigue, premature freezing of the feet during winter sport activities and even increased adrenaline production and symptoms of stress. On the other hand, if the outer shell is only "loosely" closed with relatively little force, the inner boot is able to shift relative to the outer shell. This is undesirable for most sport activities, e.g., skiing, snowboarding, etc., because the foot is not sufficiently supported in the boot and forces can no longer be precisely transmitted from the foot to the equipment, e.g., skis or snowboard.

SUMMARY OF THE INVENTION

The invention is based in part on the objective of improving a sports boot of the initially described type in such a way that it ensures superior wearing comfort as well as adequate connection between the inner boot and the outer shell.

This objective is realized by the characteristics disclosed in claim 1. Advantageous embodiments and additional developments of the invention are disclosed in the dependent claims.

Briefly, therefore, the invention is directed to a sports boot having an outer shell; an inner boot that can be inserted into the outer shell; at least one opening in the outer shell; and at least one projection on the inner boot assigned to said at least one opening in the outer shell for positive engagement therein when the inner boot is inserted into the outer shell.

Other objects and features of the invention will be in part apparent and in part pointed out hereinbelow.

BRIEF DESCRIPTION OF THE FIGURES

Embodiments of the invention are described in greater detail below with reference to the drawings. It shows.

DETAILED DESCRIPTION OF PREFERRED EMBODIMENTS

This application claims priority from German application 10 2004 014 807.4, filed Mar. 24, 2004, the entire disclosure of which is expressly incorporated herein by reference.

The invention proposes, in principle, to couple the inner boot and the outer shell by means of a positive fit connection. This prevents the inner boot from shifting relative to the outer shell, even if the outer shell is closed only relatively loosely. This connection is produced by means of openings in the outer shell and projections on the inner boot that positively engage with said openings, where this positive fit connection results in superior coupling between the inner boot and the outer shell. Excellent wearing comfort can be achieved if these openings and projections are arranged in regions that are particularly vulnerable to developing pressure points, e.g., the ankle region, the heel region, the shank, the foot side or the tongue of the inner boot, since the outer shell does not contain any hard areas that could result in pressure points at these locations.

When the boot is used in moist surroundings, e.g., as a ski boot, snowboarding boot or a boot for similar winter sports activities, an advantageous embodiment of the invention proposes making the outside of the inner boot waterproof, such that no external moisture can enter the inner boot despite the openings in the otherwise watertight outer shell.

According to an additional development of the invention, the insertion of the inner boot into the outer shell is simplified by providing the outer shell with slots such that the side parts of the outer shell can be pivoted or bent outwardly. Such slots are preferably arranged transverse to the longitudinal boot axis in the region of the front part of the foot and/or extend essentially continuously from the boot shank to the sole of the heel region. In the first instance, a relatively rigid toe cap is formed so as to ensure high stability. Closing and holding elements are, of course, provided in order to ensure that the outer shell provides adequate support when the boot is closed. These closing and holding elements overlap the slots and thus fix the parts of the outer shell that can be moved relative to one another. This can be achieved with conventional laces, tensioning belts, toothed elements, tensioning levers, tensioning wires with winding devices or other conventional mechanisms of this type.

The invention is suitable for any type of sports boot regardless of the closing mechanism, for example, lace up boots, buckle type boots or even so called "rear entry boots," in which the heel section can be pivoted rearward in order to open the boot.

Figure 1:
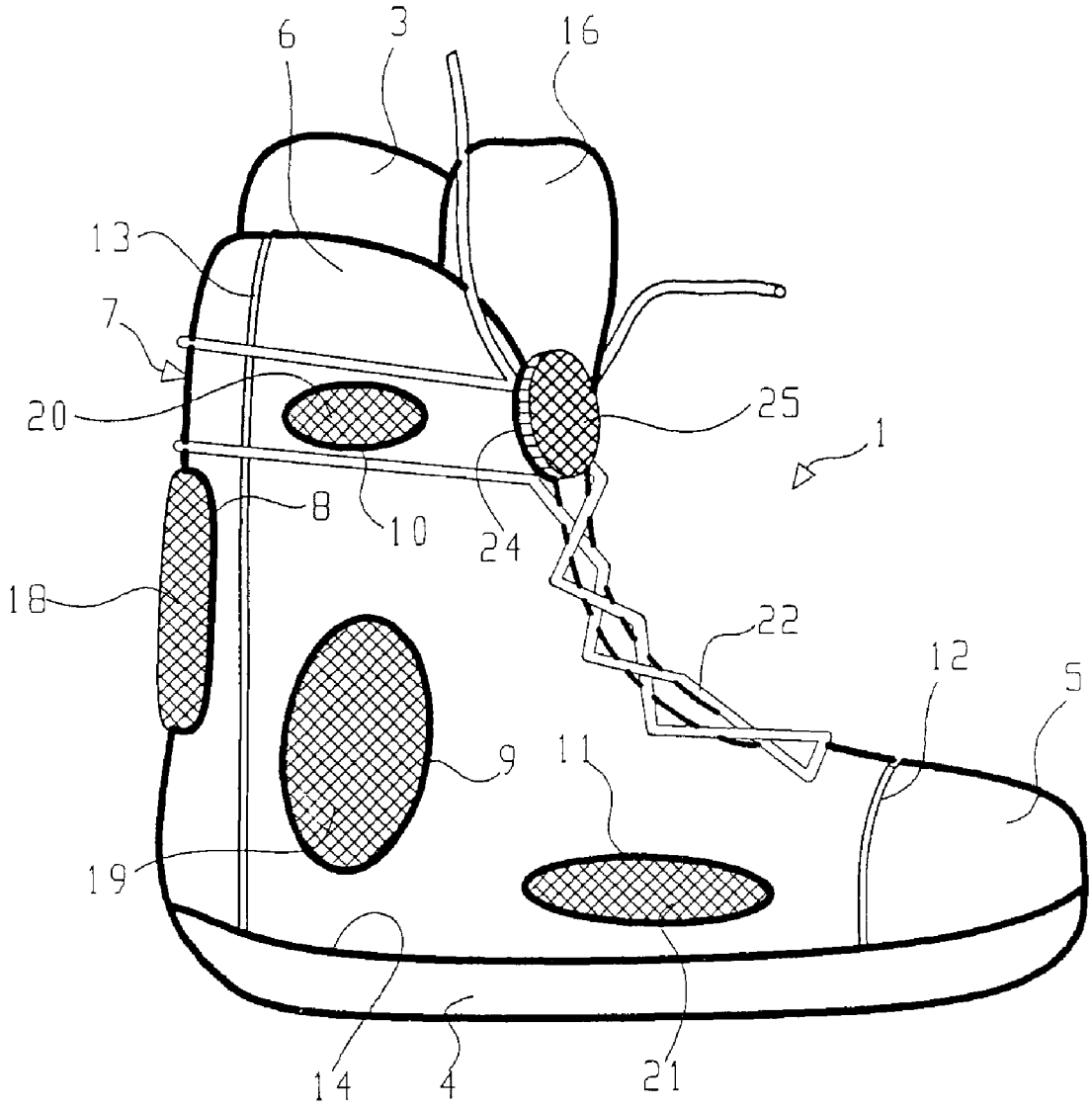
FIG. 1, a side view of a first embodiment of a sports boot according to the invention.
Figure 2:
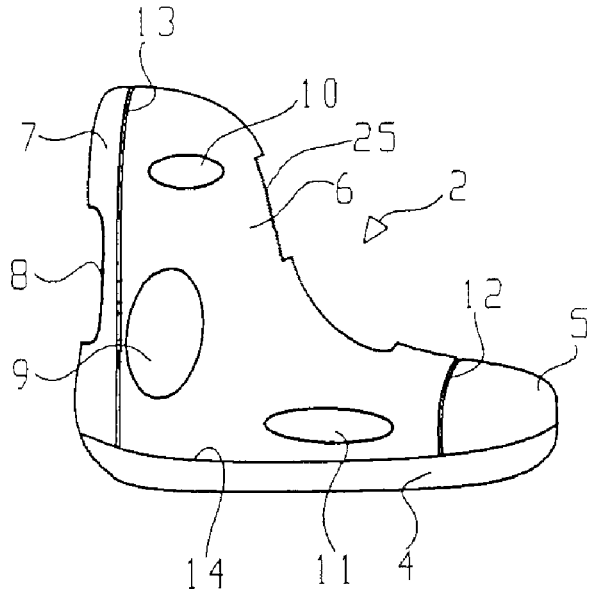
FIG. 2, a side view of the outer shell of the sports boot according to FIG. 1.
Figure 3:
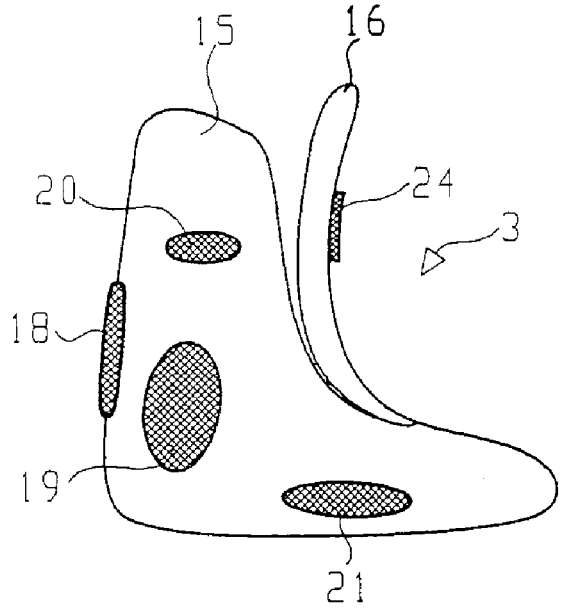
FIG. 3, a side view of the inner boot of the sports boot according to FIG. 1.

The initial portion of the following more detailed description refers to FIGS. 1-3. The sports boot overall is designated by reference number 1 and comprises an outer shell 2 of relatively rigid synthetic material and an inner boot 3 that consists of comparatively less rigid cushioned material and can be inserted into the outer shell. The outer shell 2 is connected to a sole 4, which could also be realized integrally with the outer shell.

In the embodiment shown in FIGS. 1 and 2, the outer shell comprises a toe cap 5, two side parts 6, and a heel part 7. The heel part contains an opening 8 with a closed peripheral outline. Similarly, the side parts 6 contain openings 9, 10 and 11, which also have a closed peripheral outline. The opening 9 is arranged in the ankle region. The opening 10 is located in the upper region of the boot shank, and the opening 11 is located near the sole of the side parts, approximately the central foot region behind the toe area.

Figure 4:
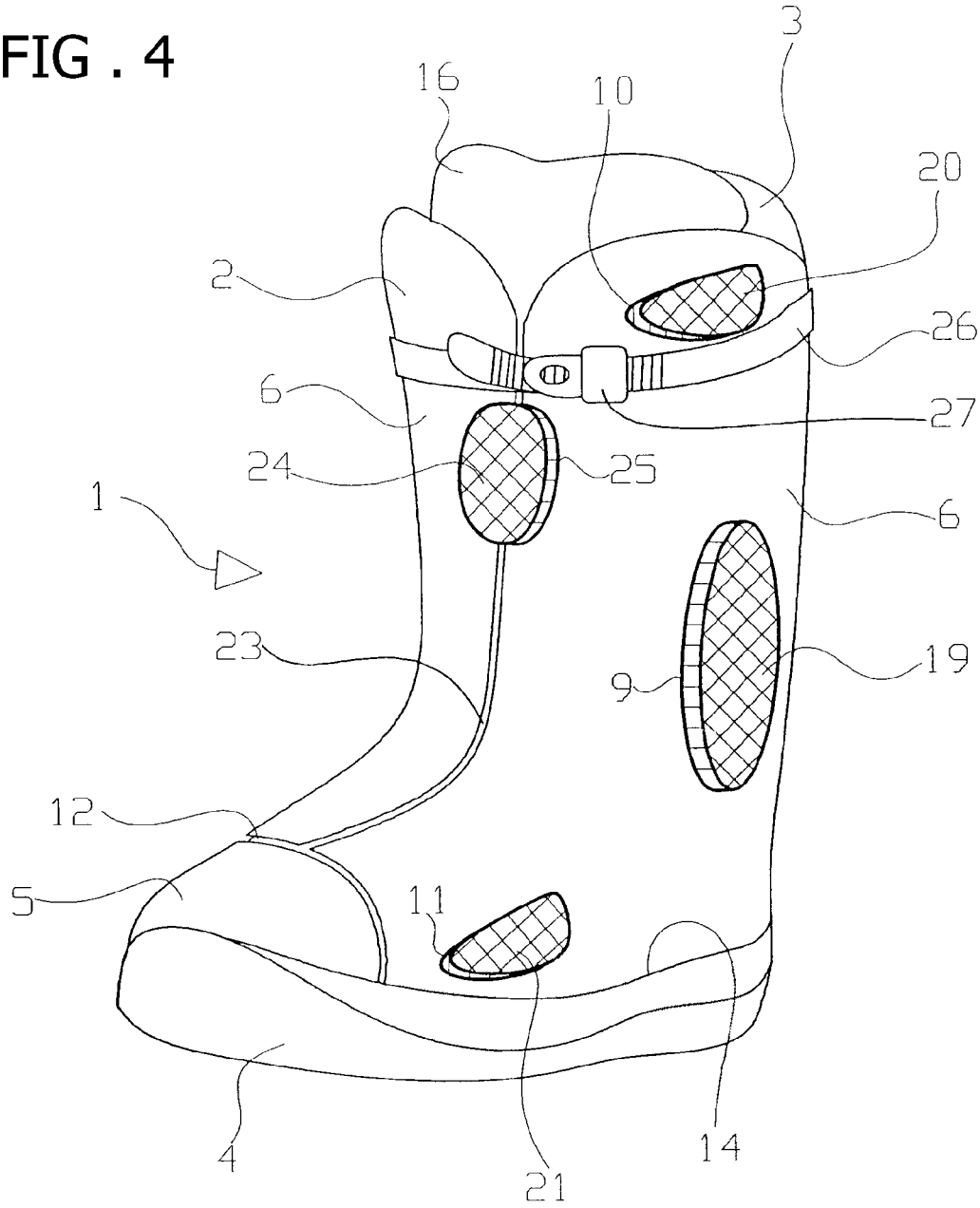
FIG. 4, a perspective representation of a second embodiment of a sports boot according to the invention, in an oblique front view.

The two side parts 6 are separated from the toe cap 5 by a slot like opening 12. The two side parts are also separated from the heel part 7 by slot like openings 13 on both sides of the boot. FIG. 4, in particular, shows that both side parts are separated by an opening 23. This makes it possible to slightly pivot both side parts 6 outwardly relative to the sole 4, where the connection between the side parts 6 and the sole 4 effectively acts as a hinge 14.

The inner boot 3 shown in FIG. 3 consists of elastic cushioned material and comprises an inner boot support body 15 with a tongue 16 that also consists of cushioned material. The outside of the inner boot is made waterproof. This can be achieved by providing the inner boot with an additional coating of a waterproofing agent or by realizing the outer material accordingly. Several projections 18, 19, 20, and 21 are arranged on the outside of the inner boot, where said projections are assigned and have the outline of the openings 9, 10, 11, 12 in the outer shell. There may also be openings and projections similar to openings 9, 10, and 11 and projections 19, 20, and 21 on the other side of the boot. When the inner boot 3 is inserted into the outer shell 2, these projections positively engage in the aforementioned openings in the outer shell. In other words, the projection 18 engages in the opening 8, the projection 19 engages in the opening 9, the projection 20 engages in the opening 10 and the projection 21 engages in the opening 11. The tongue 16 may also be provided with a projection 24 that can be engaged in an opening 25 on the front side of the side parts 6. This is illustrated particularly well in FIG. 4. The projections 18, 21, and 24 may consist of a more rigid material than that of the inner boot such that the inner boot is adequately and quite inflexibly fixed in the outer shell. The attachment of the projections can be realized by conventional methods, for example, bonding, sewing, or welding. In this respect, bonding and welding are preferred in light of the required waterproofness.

In the embodiment shown in FIG. 1, the boot is closed by means of conventional laces 22, where the laces customarily extend through (not shown) eyelets, loops or deflecting elements. The laces must be configured such that they cover the slot shaped openings 13 and 23 in order to fix the side parts 6 and the heel part 7 of the outer shell 2 relative to one another. According to FIG. 1, the laces extend around the heel part 7 in the upper region of the boot shank.

The inner boot 3 may also be provided with conventional laces or be realized such that it can be closed with Velcro fasteners. In this case, the inner boot can also be used without the outer shell, for example, in order to walk more comfortably or to drive a car. When the inner boot 3 is inserted into the outer shell 2, the two side parts 6 and, if applicable, the heel part 7 are respectively bent or pivoted outwardly. The inner boot 3 is then inserted until all projections are engaged in the assigned openings. Subsequently, the boot is closed, for example, by tightening the laces 22.

FIG. 4 shows a variation of a sports boot, in which the two side parts 6 are separated from one another by a narrow slot shaped opening 23, where both side parts 6 contain an opening 25 that does not have a closed peripheral outline and serves to receive and produce a positive fit connection with a projection 24 arranged on the tongue 16 of the inner boot 3. This boot is closed with the aid of a toothed strap 26 that cooperates with a buckle 27 and encompasses the boot in the shank region. In other respects, this embodiment corresponds to that described above with reference to FIGS. 1-3.

In conclusion, it should also be noted that not all projections and openings shown in the figures must be used, and that the invention, depending on the intended use, is also functional with only one projection and one opening, for example, the projection 18 and the opening 8 in the heel region. This would already cause the heel to be fixed relatively well. Accordingly, there is at least one pair of opening and projection; e.g., one such pair; e.g, at least three such pairs; e.g., eight such pairs.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above methods and products without departing from the scope of the invention, it is intended that all matter contained in the above description and shown in the accompanying drawings shall be interpreted as illustrative and not in a limiting sense.

What is claimed is:

1. A sports boot comprising:

an outer shell;

an inner boot of a cushioned material that can be inserted into the outer shell;

openings in the outer shell;

projections on the inner boot assigned to said openings in the outer shell for positive engagement therein when the inner boot is inserted into the outer shell, wherein of the projections is more rigid than the cushioned material of the inner boot and the projections are attached to the inner boot by bonding, sewing, or welding.

2. The sports boot of claim 1 wherein the inner boot has a waterproof exterior.

3. The sports boot according to claim 2 wherein said projections and said openings are arranged in a region of the sports boot selected from among an ankle region, a heel region, a shank region, a side region near the sole, and a tongue region.

4. The sports boot according to claim 1 wherein said projections and said openings are arranged in a region of the sports boot selected from among an ankle region, a heel region, a shank region, a side region near the sole, and a tongue region.

5. A sports boot comprising:

an outer shell;

an inner boot of a cushioned material that can be inserted into the outer shell;

at least three openings in the outer shell; and at least three projections on the inner boot assigned to said at least three openings in the outer shell for positive engagement therein when the inner boot is inserted into the outer shell;

wherein material of the at least three projections is more rigid than the cushioned material of the inner boot, and the at least three projections are attached to the inner boot by bonding, sewing, or welding.

6. The sports boot according to claim 5 wherein said at least three projections and said at least three openings are arranged in regions of the sports boot selected from among an ankle region, a heel region, a shank region, a side region near the sole, and a tongue region.

7. The sports boot according to claim 5 wherein: said at least three openings in the outer shell comprises eight openings in the outer shell; and said at least three projections on the inner boot comprises eight projections on the inner boot assigned to said eight openings in the outer shell for positive engagement therein when the inner boot is inserted into the outer shell.

8. The sports boot according to claim 7 wherein said eight projections and said eight openings are arranged in regions of the sports boot selected from among an ankle region, a heel region, a shank region, a side region near the sole, and a tongue region.

9. The sports boot according to claim 5 wherein the outer shell comprises slot-shaped openings separating the heel region from side parts of the outer shell.

10. The sports boot according to claim 5 wherein the outer shell is divided into left and right parts by a forward-extending slot-shaped opening.

11. The sports boot according to 1 wherein the outer shell comprises slot-shaped openings separating a heel region from side parts of the outer shell.

12. The sports boot according to claim 1 wherein the outer shell is divided into left and right parts by a forward-extending slot-shaped opening.

13. A sports boot comprising:

an outer shell, wherein a toe cap of the outer shell is separated from side parts of the outer shell by a slot-shaped opening;

an inner boot that can be inserted into the outer shell;

at least one opening in the outer shell;

at least one projection on the inner boot assigned to said at least one opening in the outer shell for positive engagement therein when the inner boot is inserted into the outer shell.

14.

A sports boot comprising:

an outer shell;

an inner boot of a cushioned material that can be inserted into the outer shell;

at least one opening in the outer shell; and at least one projection on the inner boot assigned to said at least one opening in the outer shell for positive engagement therein when the inner boot is inserted into the outer shell, wherein the at least one projection consists of material that is more rigid than the cushioned material of the inner boot and the at least one projection is attached to the inner boot by bonding, sewing, or welding;

wherein said at least one projection and said at least one opening are arranged in a region of the sports boot selected from among an ankle region, a heel region, a shank region, a side region near the sole, and a tongue region; and wherein a toe cap of the outer shell is separated from side parts of the outer shell by a slot-shaped opening.

15. The sports boot according to claim 13 wherein the inner boot consists of a cushioned material and said at least one projection consists of material that is more rigid than the cushioned material of the inner boot.

16. The sports boot according to claim 1 wherein said projections are bonded or welded to an exterior of the inner boot.

* * * * *